US005376034A

United States Patent [19]

Meisenburg et al.

[11] Patent Number: 5,376,034

[45] Date of Patent: Dec. 27, 1994

[54] MARINE DRIVE EXHAUST SYSTEM

[75] Inventors: Gary L. Meisenburg; Edward C. Eick; Phillip D. Magee, all of Stillwater, Okla.

[73] Assignee: Brunswick Corporation, Lake Forest, Ill.

[21] Appl. No.: 84,347

[22] Filed: Jun. 28, 1993

Related U.S. Application Data

[63] Continuation-in-part of Ser. No. 889,495, May 27, 1992, Pat. No. 5,230,644, and a continuation-in-part of Ser. No. 889,530, May 27, 1992, Pat. No. 5,249,995.

[51] Int. Cl.[5] ..... B63H 21/32

[52] U.S. Cl. ..... 440/89; 440/81

[58] Field of Search ..... 440/57, 76, 78–81, 440/89, 900; 60/310, 313; 181/204, 235, 272

[56] References Cited

U.S. PATENT DOCUMENTS

| | | | |
|---|---|---|---|
| 2,118,209 | 5/1938 | Linthwarte | 440/78 |
| 3,952,686 | 4/1976 | Pichl | 115/17 |
| 4,630,719 | 12/1986 | McCormick | 192/21 |
| 4,679,682 | 7/1987 | Gray, Jr. et al. | 192/21 |
| 4,764,135 | 8/1988 | McCormick | 440/83 |
| 4,790,782 | 12/1988 | McCormick | 440/61 |
| 4,792,315 | 12/1988 | Karrasch et al. | 440/83 |
| 4,795,382 | 1/1989 | McCormick | 440/81 |
| 4,832,635 | 5/1989 | McCormick | 440/78 |
| 4,832,636 | 5/1989 | McCormick | 440/80 |
| 4,863,406 | 9/1989 | Bland et al. | 440/83 |
| 4,869,121 | 9/1989 | Meisenburg | 440/80 |
| 4,869,694 | 9/1989 | McCormick | 440/83 |
| 4,871,334 | 10/1989 | McCormick | 440/89 |
| 4,897,058 | 1/1990 | McCormick | 440/80 |
| 4,900,281 | 2/1990 | McCormick | 440/78 |
| 4,940,434 | 7/1990 | Kiesling | 440/57 |
| 4,993,848 | 2/1991 | John et al. | 440/78 |

*Primary Examiner*—Edwin I. Swinehart

*Attorney, Agent, or Firm*—Andrus, Sceales, Starke & Sawall

[57] ABSTRACT

A surfacing marine drive has a drive housing (20) with a fore exhaust passage (230) forward of the vertical bore (26) housing the driveshaft (36), right and left exhaust passages (232 and 234) extending rearwardly from the fore exhaust passage (230) on opposite right and left sides of the vertical bore (26), and an aft exhaust passage (236) extending rearwardly from the right and left exhaust passages (232 and 234) and aft of the vertical bore (26) and discharging exhaust into dual counterrotating surface operating propellers (12 and 14).

9 Claims, 5 Drawing Sheets

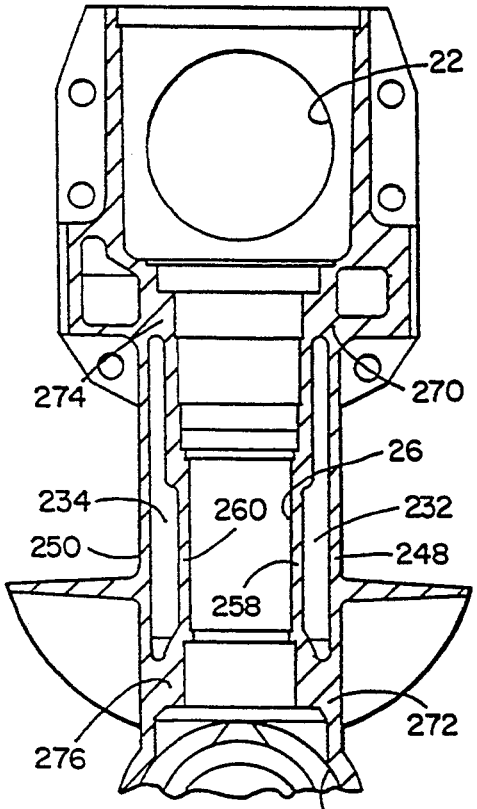
FIG. 7
FIG. 8
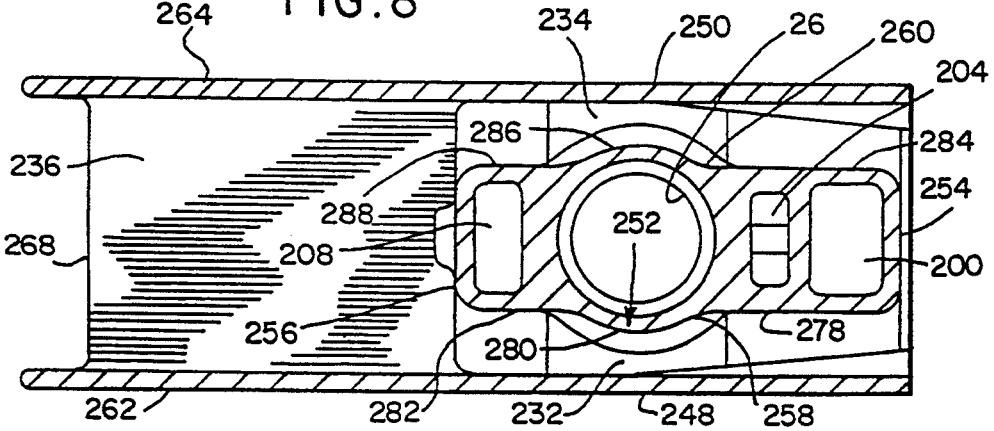

MARINE DRIVE EXHAUST SYSTEM

CROSS-REFERENCE TO RELATED APPLICATIONS

This application is a continuation-in-part of allowed U.S. application Ser. No. 07/889,495, filed May 27, 1992, now U.S. Pat. No. 5,230,664 and allowed U.S. application Ser. No. 07/889,530, filed May 27, 1992, now U.S. Pat. No. 5,249,995 incorporated herein by reference.

BACKGROUND AND SUMMARY

The invention relates to a marine drive, and more particularly to an exhaust system for a surfacing drive.

The invention arose during development efforts directed toward a surfacing marine drive enabling increased top end boat speed. Surfacing drives are known in the art, for example U.S. Pat. No. 4,871,334, column 3, lines 35+.

Exhaust systems discharging exhaust into the propellers are also known in the art, for example FIG. 2 of the noted '334 patent.

The present invention provides an improved exhaust system.

Figure 1:
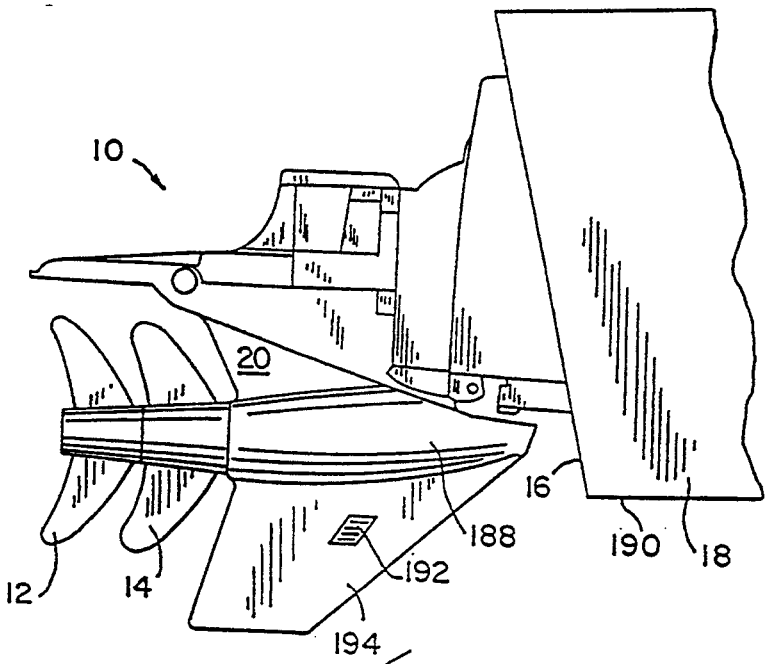
FIG. 1 is a side elevation view of a marine drive in the noted parent applications.

Pig. 4 is an exploded isometric view of a portion of the structure of FIG. 1.

Figure 5:
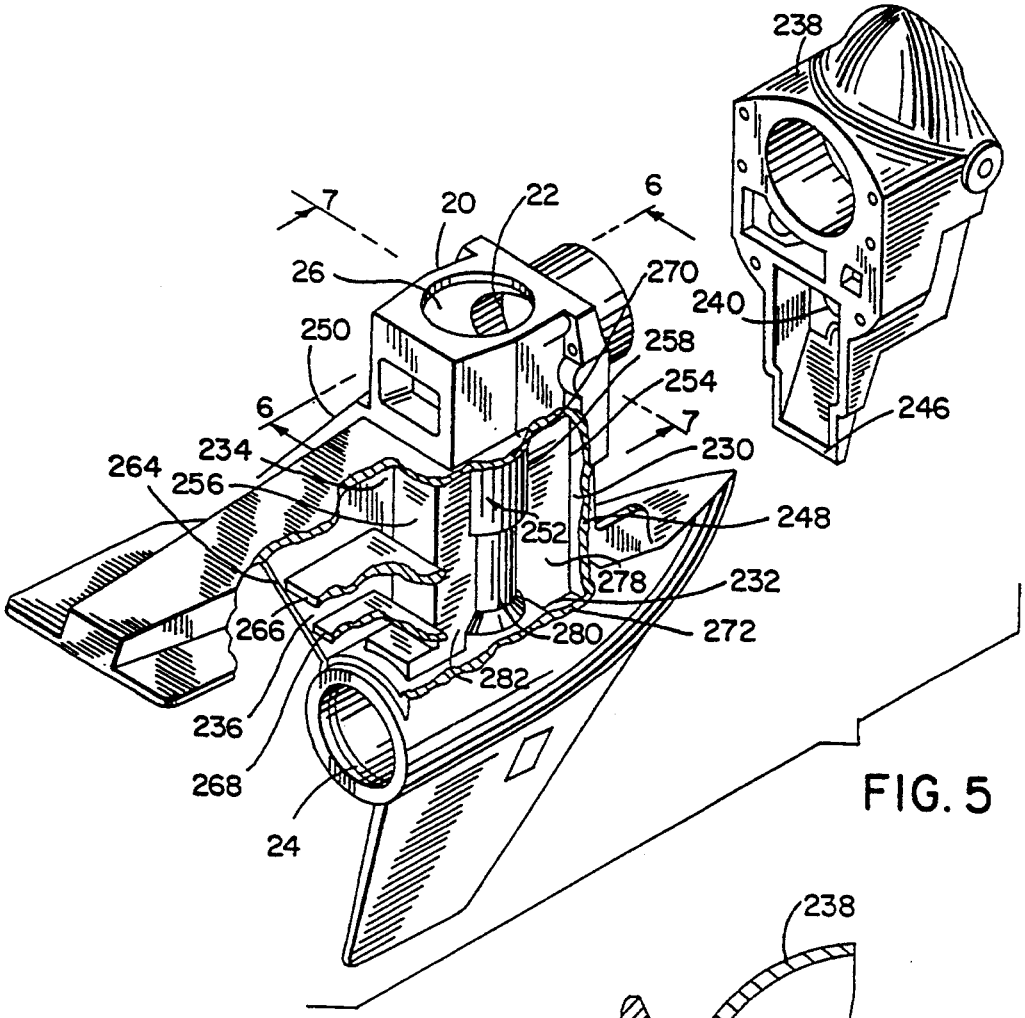

FIG. 5 is an exploded isometric view of a portion of the structure of FIG. 1, partially cut away to show the exhaust in accordance with the present invention.

Figure 6:
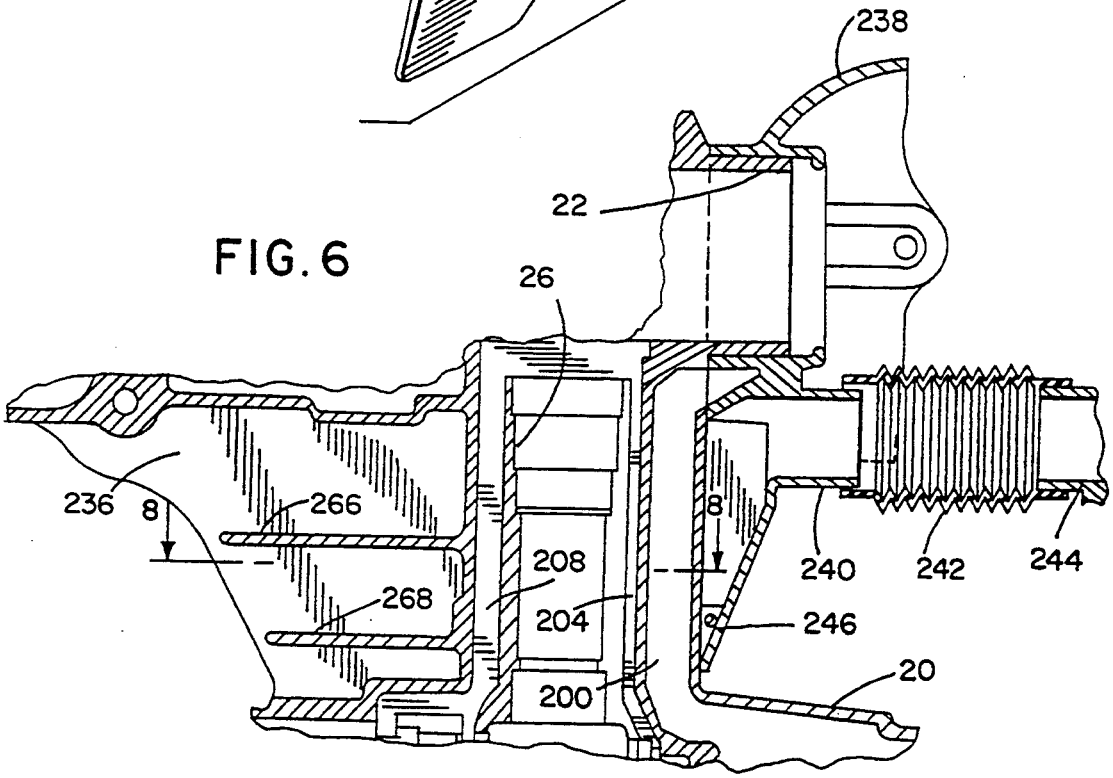

FIG. 6 is a sectional view taken along line 6—6 of FIG. 5.

FIG. 7 is a sectional view taken along line 7—7 of FIG. 5.

FIG. 8 is a sectional view taken along line 8—8 of FIG. 6.

DETAILED DESCRIPTION

FIG. 1 shows a marine drive 10 having two counter-rotating surface operating propellers 12 and 14. The drive is mounted to the transom 16 of a boat 18 in the usual manner for a stern drive. The drive includes a housing 20, FIG. 2, having upper and lower spaced horizontal bores 22 and 24, and an intersecting vertical bore 26 extending therebetween. An upper input shaft 28 is in upper horizontal bore 22 and is coupled through a universal joint 30 to an input shaft 32 driven by the engine (not shown) in the boat. The universal joint enables trimming and steering of the drive. The input shaft drives an upper gear assembly 34 which is known in the art, for example as shown in U.S. Pat. Nos. 4,630,719, 4,679,682, and 4,869,121, incorporated herein by reference. A downwardly extending driveshaft 36 in vertical bore 26 is driven by input shaft 28 through upper gear assembly 34 operatively connected therebetween. Input gear 38 on shaft 28 rotates about a horizontal axis and drives gears 40 and 42 to rotate in opposite directions about a vertical axis. Shift and clutch assembly 44 causes engagement of one or the other of gears 40 and 42, to in turn cause rotation of driveshaft 36 in one or the other direction, to provide forward or reverse operation, all as in the noted incorporated patents.

Figure 3:
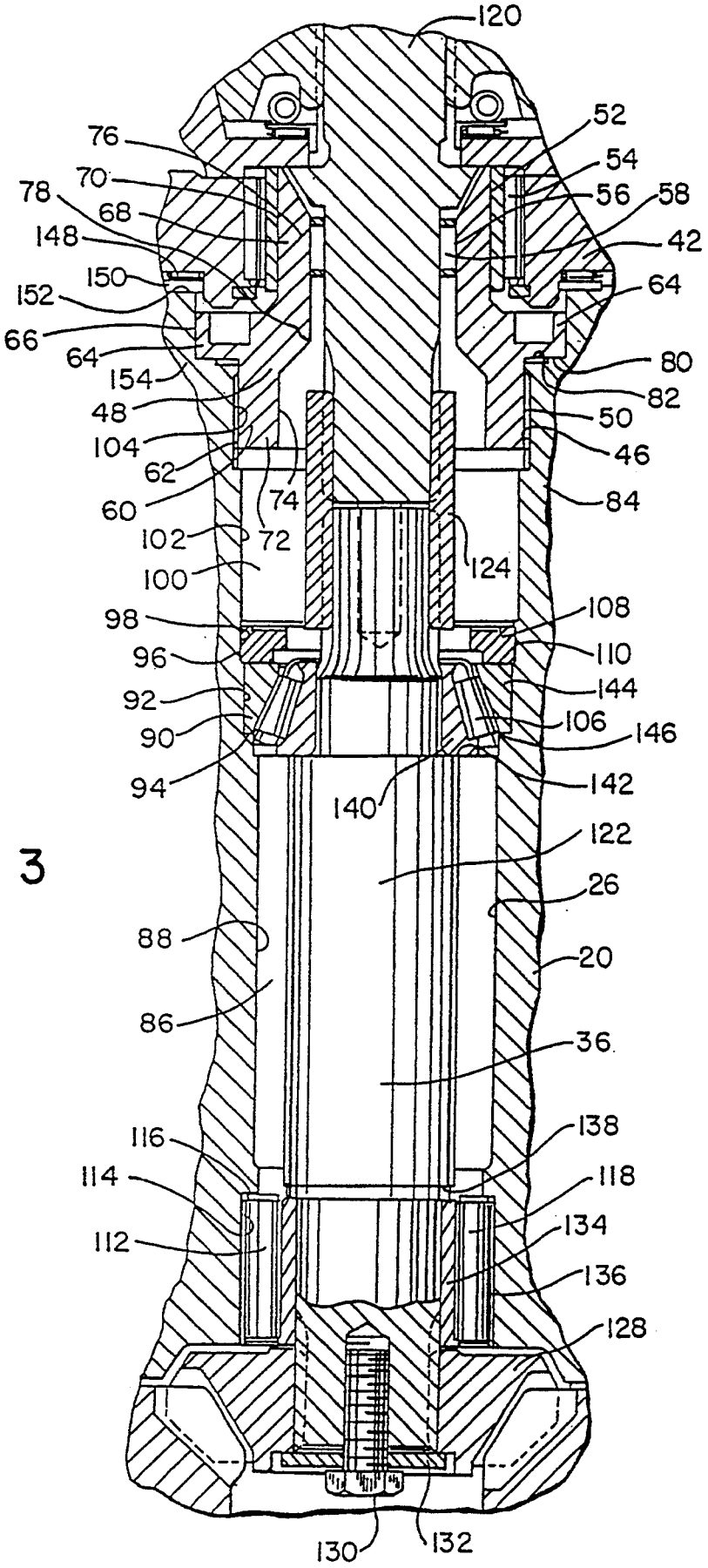
FIG. 3 is an enlarged view of a portion of the structure of FIG. 2.

Vertical bore 26 has an upper threaded portion 46, FIG. 3. An upper adaptor spool 48 has a lower threaded outer portion 50 mating with threaded portion 46 of vertical bore 26 and supporting gear 42 for rotation about driveshaft 36. Adaptor spool 48 has an upper outer surface 52 supporting an upper outer needle bearing 54 which supports gear 42 for rotation about adaptor spool 48. Adaptor spool 48 has an upper inner surface 56 supporting an upper inner needle bearing 58 which supports driveshaft 36 for rotation in adaptor spool 48.

Adaptor spool 48 has a lower outer section 60, FIG. 3, of a first outer diameter 62 and threaded as noted at 50 and mating with upper threaded portion 46 of vertical bore 26. Adaptor spool 48 has a central outer section 64 above lower outer section 60 and of a central outer diameter 66 larger than lower outer diameter 62. Adaptor spool 48 has an upper outer section 68 above central outer section 64 and of an upper outer diameter 70 less than central outer diameter 66 and less than lower outer diameter 62. Adaptor spool 48 has a lower inner section 72 of a lower inner diameter 74 within vertical bore 26. Adaptor spool 48 has an upper inner section 76 above lower inner section 72 and of an upper inner diameter 78 less than lower inner diameter 74. Upper outer needle bearing 54 is between gear 42 and upper outer section 68 of adaptor spool 48 and supports gear 42 for rotation about adaptor spool 48. Upper inner needle bearing 58 is between driveshaft 36 and upper inner section 76 of adaptor spool 48 and supports drive-shaft 36 for rotation in adaptor spool 48. Lower outer section 60 and central outer section 64 of adaptor spool 48 meet at a downwardly facing annular shoulder 80 at the top end 82 of housing sidewall 84 forming vertical bore 26. Upper outer diameter 70 is substantially equal to lower inner diameter 74 of adaptor spool 48.

Figure 4:
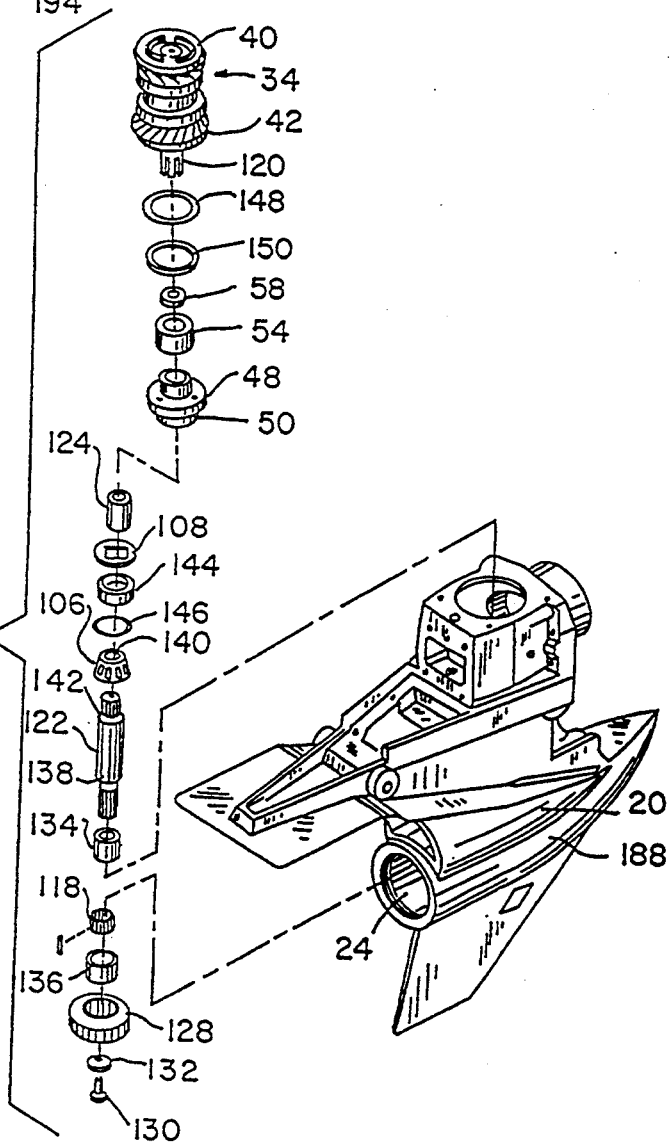

Vertical bore 26 has a first section 86, FIG. 3, of a first inner diameter 88. Vertical bore 26 has a second section 90 above first section 86 and of a second inner diameter 92 larger than inner diameter 88. Sections 86 and 90 meet at an upwardly facing annular shoulder 94. Vertical bore 26 has a first thread 96 above second section 90 and of an inner diameter 98 at least as great as second inner diameter 92. Vertical bore 26 has a third section 100 above first thread 96 and of a third inner diameter 102 greater than second inner diameter 98. Vertical bore 26 has a second thread, provided by the noted thread 46, above third section 100 and of an inner diameter 104 at least as great as third inner diameter 102. A central tapered roller thrust bearing 106 is seated against shoulder 94 of vertical bore 26. An annular ring 108 has a threaded outer portion 110 mating with thread 96 of vertical bore 26 and retains bearing 106 against shoulder 94. Vertical bore 26 has a fourth section 112 below first section 86 and of a fourth inner diameter 114 larger than first inner diameter 88. First and fourth sections 86 and 112 meet at a downwardly facing annular shoulder 116. A lower needle bearing 118 is seated against downwardly facing shoulder 116 and supports driveshaft 36 for rotation. Central and upper bearings 106 and 58 are inserted into vertical bore 26 from above, FIG. 4. Lower bearing 118 is inserted into vertical bore 26 from below.

Driveshaft 36, FIG. 3, is a two piece member formed by an upper driveshaft segment 120 and a lower driveshaft segment 122 coupled by a sleeve 124 in splined relation. Central bearing 106 and lower bearing 118 support the lower driveshaft segment 122. Upper bearing 58 supports the upper driveshaft segment 120. The upper driveshaft segment is also supported by another upper needle bearing 126, FIG. 2, as in the noted incorporated patents.

Driveshaft 36 has a lower pinion gear 128, FIG. 3, mounted thereto by bolt 130 and washer 132. Needle bearing .118 is above pinion gear 128 and is supported between inner and outer races 134 and 136. Outer race 136 engages shoulder 116, and inner race 134 engages shoulder 138 on lower driveshaft segment 122. Bearing 106 has an inner race 140 engaging shoulder 142 on lower driveshaft segment 122. Bearing 106 has an outer race 144 stopped against shoulder 94 in bore 26. One or more shims 146 may be provided between outer race 144 and shoulder 94 to adjust axial positioning if desired. Gear 42 rotates on bearing 148 on race 150 seated on shoulder 152 of housing sidewall 154.

Figure 2:
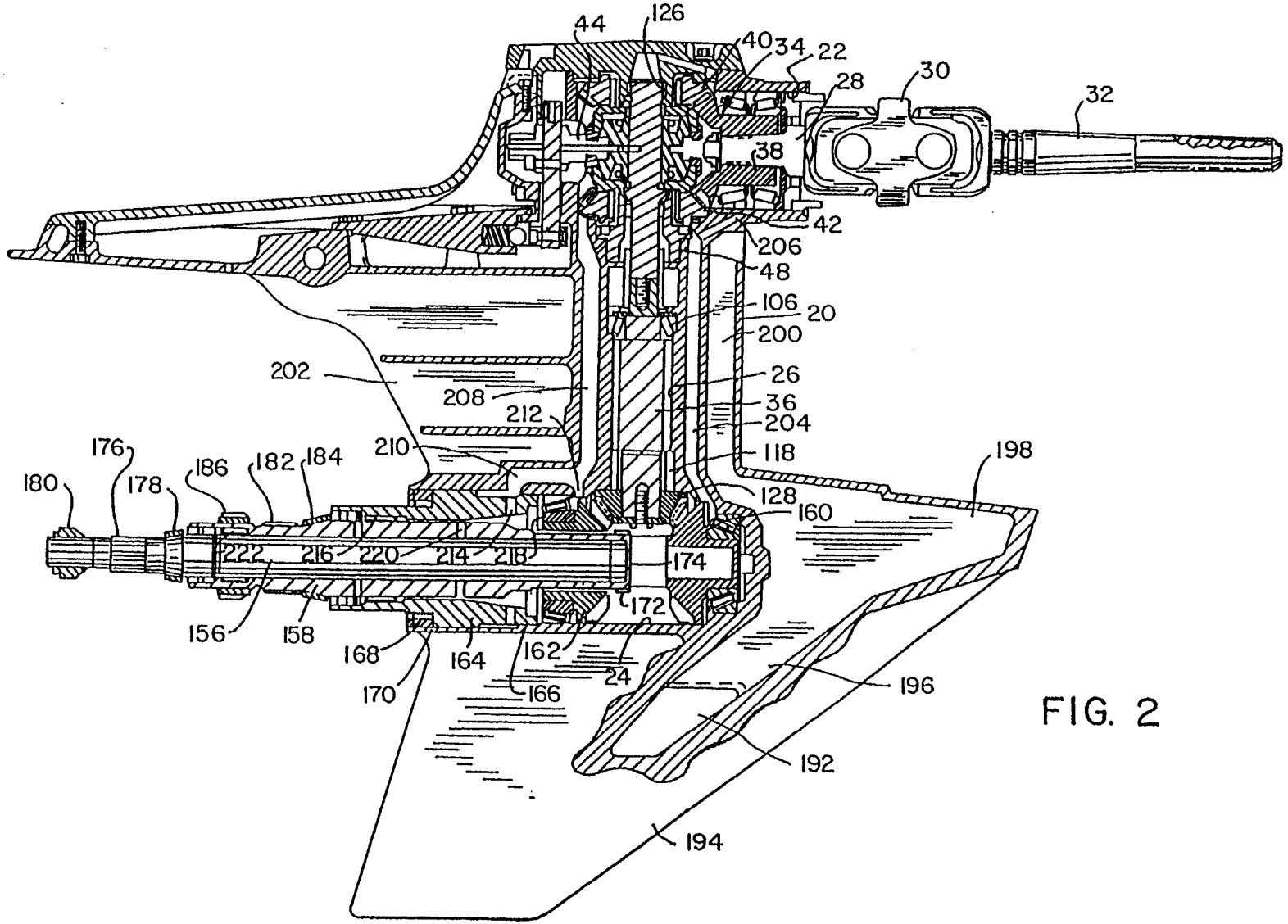
FIG. 2 is a partial sectional view of a portion of the structure of FIG. 1.

A pair of lower concentric counter-rotating inner and outer propeller shafts 156 and 158, FIG. 2, in lower horizontal bore 24 are driven by driveshaft 36. Inner propeller shaft 156 has a fore gear 160 driven by pinion gear 128 to drivingly rotate inner propeller shaft 156. Outer propeller shaft 158 has an aft gear 162 driven by pinion gear 128 to drivingly rotate outer propeller shaft 158 in the opposite rotational direction than inner propeller shaft 156. Reference is made to allowed incorporated U.S. application Ser. No. 07/889,530, filed May 27, 1992. The dual propeller shaft assembly is mounted in horizontal bore 24 by a spool assembly 164 at right hand threads 166 and retaining ring 168 having left hand threads 170. The right hand threads prevent right hand rotational loosening of the spool assembly, and the left hand threads 170 prevent left hand rotational loosening of the spool assembly. Forward thrust is transferred from the outer propeller shaft 158 to the inner propeller shaft 156 at thrust bearing 172 against annular shoulder 174 on inner propeller shaft 156. Propeller 12 is mounted on inner propeller shaft 156 in splined relation at 176 between tapered ring 178 and threaded nut 180. Propeller 14 is mounted on outer propeller shaft 158 in splined relation at 182 between tapered ring 184 and threaded nut 186.

The vertical distance between adaptor spool 48 and lower bearing 118 is about equal to the radius of propellers 12 and 14. Lower horizontal bore 24 of housing 20 is in the portion commonly called the torpedo 188, FIGS. 1 and 4. Torpedo 188 is slightly above the bottom 190 of boat 18 and hence is slightly above the surface of the water, thus reducing drag. This raising of the torpedo above the surface of the water is accomplished without a like raising of the engine in the boat nor the usual transom mounting location for the drive. In the preferred embodiment, the engine is raised 2 to 3 inches above its standard location. Housing 20 is a one-piece unitary integrally cast housing replacing prior two piece housings. Propeller shafts 156, 158 are spaced from upper input shaft 28 by a distance along driveshaft 36 in the range of about 8 to 15 inches.

Cooling water for the engine is supplied through water intake 192 in skeg 194, and flows through skeg passage 196 and then through torpedo nose passage 198 and then through housing passage 200 to the engine in the usual manner. After cooling the engine, the water and engine exhaust are exhausted in the usual manner through an exhaust elbow and exhausted through the housing and discharged at exhaust outlet 202 above torpedo 188 and into the path of the propellers in the upper portion of their rotation, as in U.S. Pat. No. 4,871,334. Oil is circulated from the lower gears upwardly through passage 204 and passage 206 to the upper gears, and returned to the lower gears at passage 208 feeding passages 210 and 212. Oil is supplied from passage 210 through spool assembly passage 214 to bearings 216 and 218, and through outer propeller shaft passage 220 to bearing 222. Passage 212 supplies oil to the front of bearing 218. Central outer section 64 of adaptor spool 48 closes off oil passage 204, to divert flow to passage 206.

Drive housing 20 has a fore exhaust passage 230, FIG. 5, forward of vertical bore 26. The drive housing has right and left exhaust passages 232 and 234, FIGS. 5, 7 and 8, extending rearwardly from fore exhaust passage 230 and on opposite right and left sides of vertical bore 26. The drive housing has an aft exhaust passage 236 extending rearwardly from right and left exhaust passages 232 and 234, and aft of vertical bore 26 and discharging exhaust into propellers 12 and 14. Bell housing 238, FIG. 5, is mounted to drive housing 20 and has an exhaust inlet 240, FIG. 6, receiving engine exhaust in the normal manner through bellows 242 from transom plate exhaust outlet 244. The bell housing has a lower flange 246 mating with the drive housing at fore exhaust passage 230 to transfer exhaust thereto.

Exhaust flows horizontally around and past vertical bore 26 along a path horizontally coplanar with discharge into propellers 12 and 14. Fore exhaust passage 230, right exhaust passage 232, left exhaust passage 234, and aft exhaust passage 236, are all horizontally coplanar. The exhaust passages define a horizontal path from forward of vertical bore 26 to aft of vertical bore 26. The drive housing has right and left sidewalls 248 and 250, FIGS. 4, 7 and 8, spaced outwardly of vertical bore 26 and defining the right and left exhaust passages 232 and 234 therebetween. Exhaust flows horizontally rearwardly through right and left exhaust passages 232 and 234 past vertical bore 26 and then continues along the same horizontal plane into and through aft exhaust passage 236 and then continues along the same horizontal plane into propellers 12 and 14.

The drive housing has a vertically extending inner core 252, FIG. 5, defined by a front inner wall 254 and a rear inner wall 256, and by right and left inner sidewalls 258 and 260, FIG. 8, extending fore-to-aft between front inner wall 254 and rear inner wall 256. Vertical bore 26 is in inner core 252. Right outer sidewall 248 is spaced laterally outwardly of right inner sidewall 258 and defines right exhaust passage 232 therebetween. Left outer sidewall 250 is spaced laterally outwardly of left inner sidewall 260 and defines left exhaust passage 234 therebetween. Right and left outer sidewalls 248 and 250 have aft extensions 262 and 264, respectively, extending rearwardly past rear inner wall 256 and defining aft exhaust passage 236, FIG. 5, therebetween. Planar plate members 266 and 268, FIGS. 5 and 6, extend rearwardly from rear inner wall 256 and extend laterally between aft extensions 262 and 264 of right and left outer sidewalls 248 and 250. Exhaust flows horizontally rearwardly through right and left exhaust passages 232 and 234 past vertical bore 26 and then continues along the same horizontal path into and through aft exhaust passage 236 and then continues along the same horizontal plane into the propellers.

Right exhaust passage 232 is adjacent vertical bore 26 between upper adaptor spool 48, FIG. 2, and lower bearing 118 and extends horizontally from forward of vertical bore 26 to aft of vertical bore 26. Left exhaust passage 234 is adjacent vertical bore 26 between upper adaptor spool 48 and lower bearing 118 and extends horizontally from forward of vertical bore 26 to aft of vertical bore 26. Right exhaust passage 232 is defined by the noted right inner sidewall 258 extending from forward of vertical bore 26 to aft of vertical bore 26 and extending from upper horizontal bore 22 downwardly to lower horizontal bore 24. Right exhaust passage 232 is defined by right outer sidewall 248 spaced laterally outwardly of right inner sidewall 258. Right exhaust passage 232 is defined by a top wall 270 extending laterally between inner and outer sidewalls 258 and 248. Right exhaust passage 232 is defined by a bottom wall 272 extending laterally between inner and outer sidewalls 258 and 248. Left exhaust passage 234 is defined by left inner sidewall 260 extending from forward of vertical bore 26 to aft of vertical bore 26 and extending from upper horizontal bore 22 downwardly to lower horizontal bore 24. Left exhaust passage 234 is defined left outer sidewall 250 spaced laterally outwardly of left inner sidewall 260. Left exhaust passage 234 is defined by a top wall 274 extending laterally between inner and outer sidewalls 260 and 250. Left exhaust passage 234 is defined by a bottom wall 276 extending laterally between inner and outer sidewalls 260 and 250. Right inner wall 258 defines vertical bore 26 on the opposite side thereof from right exhaust passage 232. Left inner wall 260 defines vertical bore 26 on the opposite side thereof from left exhaust passage 234. Lower walls 272 and 276 are at the top of lower horizontal bore 24. Upper walls 270 and 274 are at the bottom of upper horizontal bore 22.

Right inner sidewall 258, FIGS. 5 and 8, includes a flat planar forward portion 278, a middle portion 280 curved outwardly toward right outer sidewall 248 and into right exhaust passage 232 along an arc defining vertical bore 26, and a flat planar rearward portion 282. Forward and rearward portions 278 and 282 of right inner sidewall 258 are in the same fore-to-aft vertical plane. Left inner sidewall 260 includes a flat planar forward portion 284, a middle portion 286 curved outwardly toward left outer sidewall 250 and into left exhaust passage 234 along an arc defining vertical bore 26, and a flat planar rearward portion 288. Forward and rearward portions 284 and 288 of left inner sidewall 260 are in the same fore-to-aft vertical plane.

It is recognized that various equivalents, alternatives and modifications are possible within the scope of the appended claims.

We claim:

1. A marine drive for propelling a boat comprising:

a housing having upper and lower horizontal bores and an intersecting vertical bore extending therebetween;

an upper input shaft in said upper horizontal bore;

a downwardly extending driveshaft in said vertical bore and driven by said input shaft;

a pair of lower concentric counter-rotating propeller shafts in said lower horizontal bore and driven by said driveshaft;

a pair of counter-rotating surface operating propellers each mounted to a respective one of said propeller shafts;

said housing having a fore exhaust passage forward of said vertical bore, right and left exhaust passages extending rearwardly from said fore exhaust passage and on opposite right and left sides of said vertical bore, and an aft exhaust passage extending rearwardly from said right and left exhaust passages and aft of said vertical bore and discharging exhaust into said propellers, wherein exhaust flows horizontally around and past said vertical bore along a path horizontally coplanar with the path of exhaust discharge into said propellers.

2. The invention according to claim 1 wherein said fore exhaust passage, said right exhaust passage, said left exhaust passage, and said aft exhaust passage are all horizontally coplanar.

3. The invention according to claim 1 wherein said exhaust passages define a horizontal path from forward of said vertical bore to aft of said vertical bore.

4. A marine drive for propelling a boat comprising:

a housing having upper and lower horizontal bores and an intersecting vertical bore extending therebetween;

an upper input shaft in said upper horizontal bore;

a downwardly extending driveshaft in said vertical bore and driven by said input shaft;

a pair of lower concentric counter-rotating propeller shafts in said lower horizontal bore and by said driveshaft;

a pair of counter-rotating surface operating propellers each mounted to a respective one of said propeller shafts;

said housing having a fore exhaust passage forward of said vertical bore, right and left exhaust passages extending rearwardly from said fore exhaust passage and on opposite right and left sides of said vertical bore, and an aft exhaust passage extending rearwardly from said right and left exhaust passages and aft of said vertical bore and discharging exhaust into said propellers, wherein said housing has right and left sidewalls spaced outwardly of said vertical bore and defining said right and left exhaust passages therebetween, wherein exhaust flows horizontally rearwardly through said right and left exhaust passages past said vertical bore and then continues horizontally into and through said aft exhaust passage and then continues along the same horizontal plane into said propellers.

5. A marine drive for propelling a boat comprising:

a housing having upper and lower horizontal bores and an intersecting vertical bore extending therebetween;

an upper input shaft in said upper horizontal bore;

a downwardly extending driveshaft in said vertical bore and driven by said input shaft;

a pair of lower concentric counter-rotating propeller shafts in said lower horizontal bore and driven by said driveshaft;

a pair of counter-rotating surface operating propellers each mounted to a respective one of said propeller shafts;

said housing having a vertically extending inner core defined by a front inner wall, a rear inner wall, and right and left inner sidewalls extending fore-to-aft between said front and rear inner walls, said vertical bore being in said inner core, said housing having a right outer sidewall spaced outwardly of said right inner sidewall and defining a right exhaust passage therebetween, said housing having a left outer sidewall spaced outwardly of said heft inner sidewall and defining a left exhaust passage therebetween, said right and left outer sidewalls having aft extensions extending rearwardly past said rear inner wall and defining an aft exhaust passage therebetween;

at least one generally planar plate member extending rearwardly from said rear inner wall and extending laterally between said aft extensions of said right and left outer side-walls.

6. A marine drive for propelling a boat comprising:

a housing having upper and lower horizontal bores and an intersecting vertical bore extending therebetween;

an upper input shaft in said upper horizontal bore;

a downwardly extending driveshaft in said vertical bore and driven by said input shaft;

a pair of lower concentric counter-rotating propeller shafts in said lower horizontal bore and driven by said driveshaft;

a pair of counter-rotating surface operating propellers each mounted to a respective one of said propeller shafts;

said housing having a vertically extending inner core defined by a front inner wall, a rear inner wall, and right and left inner side-walls extending fore-to-aft between said front and rear inner walls, said vertical bore being in said inner core, said housing having a right outer sidewall spaced outwardly of said right inner sidewall and defining a right exhaust passage therebetween, said housing having a left outer sidewall spaced outwardly of said left inner sidewall and defining a left exhaust passage therebetween, said right and left outer side-walls having aft extensions extending rearwardly past said rear inner wall and defining an aft exhaust passage therebetween, wherein exhaust flows horizontally rearwardly through said right and left exhaust passages past said vertical bore and then continues horizontally into and through said aft exhaust passage and then continues along the same horizontal plane into said propellers.

7. A marine drive for propelling a boat comprising:

a housing having upper and lower horizontal bores and an intersecting vertical bore extending therebetween;

an upper input shaft in said upper horizontal bore;

a downwardly extending driveshaft in said vertical bore and driven by said input shaft;

a pair of lower concentric counter-rotating propeller shafts in said lower horizontal bore and driven by said driveshaft;

a pair of counter-rotating surface operating propellers each mounted to a respective one of said propeller shafts;

an upper gear in said housing and operatively connected between said input shaft and said driveshaft;

a lower gear in said housing and operatively connected between said driveshaft and said propeller shafts;

a lower bearing at the bottom of said vertical bore and supporting said driveshaft for rotation;

an upper adaptor spool at the top of said vertical bore and supporting said driveshaft for rotation;

said housing having an exhaust passage adjacent said vertical bore between said upper adaptor spool and said lower bearing and extending horizontally from forward of said vertical bore to aft of said vertical bore, wherein said exhaust passage is defined by an inner sidewall extending from forward of said vertical bore to aft of said vertical bore and extending from said upper horizontal bore downwardly to said lower horizontal bore, an outer sidewall spaced laterally outwardly of said inner sidewall, a top wall extending laterally between said inner and outer sidewalls, and a bottom wall extending laterally between said inner and outer sidewalls, said inner wall defines said vertical bore on the opposite side thereof from said exhaust passage, said inner sidewall comprises a generally flat planar forward portion, a middle portion curved outwardly toward said outer sidewall and into said exhaust passage along an arc defining said vertical bore, and a generally flat planar rearward portion.

8. The invention according to claim 7 wherein said forward and rearward portions of said inner sidewall are in the same vertical plane.

9. A marine drive for propelling a boat comprising:

a housing having upper and lower horizontal bores and an intersecting vertical bore extending therebetween;

an upper input shaft in said upper horizontal bore;

a downwardly extending driveshaft in said vertical bore and driven by said input shaft;

a pair of lower concentric counter-rotating propeller shafts in said lower horizontal bore and driven by said driveshaft;

a pair of counter-rotating surface operating propellers each mounted to a respective one of said propeller shafts;

said housing having a vertically extending inner core defined by a front inner wall, a rear inner wall, and right and left inner side-walls extending fore-to-aft between said front and rear inner walls, said vertical bore being in said inner core, said housing having a right outer sidewall spaced outwardly of said right inner sidewall and defining a right exhaust passage therebetween, said housing having a left outer sidewall spaced outwardly of said left inner sidewall and defining a left exhaust passage therebetween, said right and left outer side-walls having aft extensions extending rearwardly past said rear inner wall and defining an aft exhaust passage therebetween;

said inner core having a plurality of vertically extending passages therein including a coolant passage and a lubricant passage.

* * * * *